US006283460B1

(12) United States Patent
Omarsson

(10) Patent No.: US 6,283,460 B1
(45) Date of Patent: Sep. 4, 2001

(54) FUEL-AIR MIXTURE APPARATUS

(76) Inventor: Kristjan Bjorn Omarsson, Grund, Villingsholltshreppi, IS-801, Selfoss (IS)

( * ) Notice: Subject to any disclaimer, the term of this patent is extended or adjusted under 35 U.S.C. 154(b) by 0 days.

(21) Appl. No.: 09/202,697

(22) PCT Filed: Jun. 16, 1997

(86) PCT No.: PCT/IB97/00781

§ 371 Date: Feb. 16, 1999

§ 102(e) Date: Feb. 16, 1999

(87) PCT Pub. No.: WO97/48897

PCT Pub. Date: Dec. 24, 1997

(30) Foreign Application Priority Data

Jun. 20, 1996 (GB) ..... 9612971

(51) Int. Cl.[7] ..... F02M 23/12

(52) U.S. Cl. ..... 261/50.1; 261/79.1; 261/81; 261/DIG. 1; 261/DIG. 38; 261/DIG. 48

(58) Field of Search ..... 261/50.1, 50.2, 261/78.1, 79.1, 81, 16, DIG. 1, DIG. 38, DIG. 83, DIG. 23, DIG. 55, DIG. 48

(56) References Cited

U.S. PATENT DOCUMENTS

| | | | | |
|---|---|---|---|---|
| 3,640,512 | * | 2/1972 | Morgenroth | 261/50.1 X |
| 3,679,186 | * | 7/1972 | Hideg | 261/50.1 |
| 4,216,753 | | 8/1980 | Inoue et al. | 123/445 |
| 4,224,908 | * | 9/1980 | Bier et al. | 261/50.1 X |
| 5,249,773 | * | 10/1993 | Feld | 261/DIG. 38 |

FOREIGN PATENT DOCUMENTS

| | | |
|---|---|---|
| 2819474 | 11/1978 | (DE) . |
| 850652 | 12/1939 | (FR) . |
| 5672244 | 6/1981 | (JP) . |
| 6001362 | 1/1985 | (JP) . |

OTHER PUBLICATIONS

PCT Notice of Transmittal of the Interntational Search Report, Form PCT/ISA/220, Oct. 2, 1997.

* cited by examiner

*Primary Examiner*—Richard L. Chiesa
(74) *Attorney, Agent, or Firm*—Sofer & Haroun, LLP

(57) ABSTRACT

An improved fuel air mixture apparatus which enhances the degree of mixing of fuel with air. The fuel-air mixture device includes a primary air passage having an inlet, an adjustable throttle and an outlet; a secondary air passage having an inlet and an outlet to the primary air passage between its adjustable throttle and its outlet; a nozzle having an orifice opening into the secondary air passage for introducing a flow of fuel therein; a needle arranged co-axially of the nozzle with its small diameter at least normally extending from the orifice into the secondary air passage, the needle being axially moveable to provide variability of the orifice and control of the fuel flow; a control device for directly linking or controlling the position of the needle to the position of the adjustable throttle in the primary air passage for adjustment of the orifice of the nozzle. The arrangement is such that the fuel flow from the nozzle is matched to the position of the adjustable throttle and the fuel flowing from the orifice towards the small diameter end of the needle mixes with air flowing through the secondary passage prior to mixing with the air flowing through the primary air passage.

26 Claims, 4 Drawing Sheets

FUEL-AIR MIXTURE APPARATUS

RELATED SPECIFICATIONS

Figure 1:
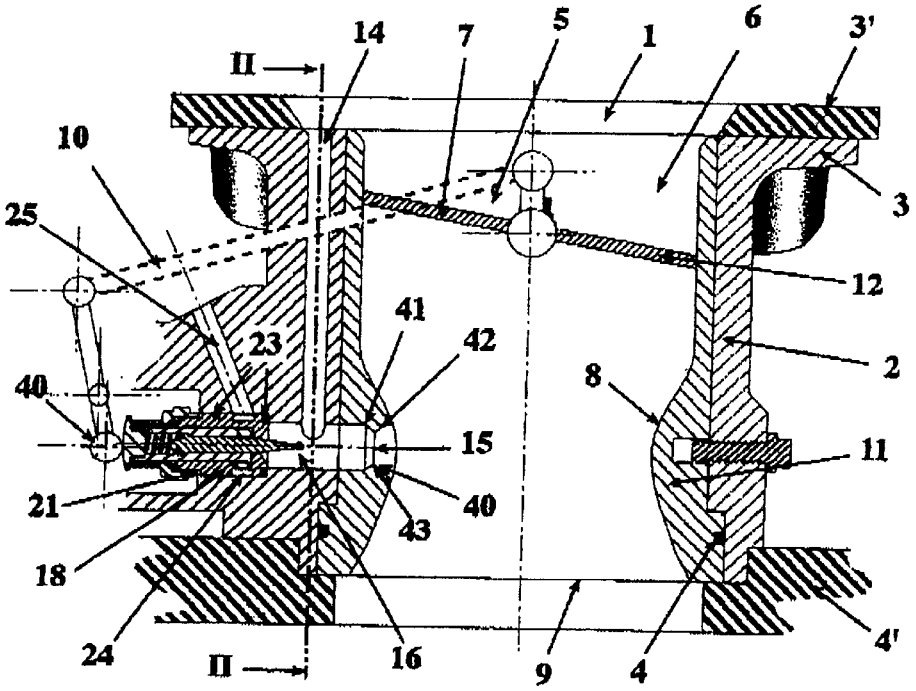

This application is a National Stage application, under 35 U.S.C. 371, of International Application No. PCT/IB97/00781, filed on Jun. 16, 1997.

BACKGROUND OF THE INVENTION

The present invention relates to a fuel-air mixture apparatus, particularly for an internal combustion engine.

Fuel-air mixture apparatuses of the type where fuel is mixed with air prior to induction into the cylinder(s) of an engine generally rely on a pressure reduction at a throttle in the device to draw fuel into the device, in which case the device is known as a carburettor, or rely on fuel injection into the air as it passes through the device.

Generally, the prior devices rely on a single stage of mixture of fuel and air and are limited as regards the droplet size and total vaporisation of the fuel in the air which they induce. Inadequate vaporisation and too large a droplet size result in unburned and/or incompletely burnt fuel being present in the exhaust from the engine.

THE INVENTION

The object of the present invention is to provide a fuel-air mixture apparatus which causes low quantities of unburned and incompletely burnt fuel to be present in the exhaust.

The fuel-air mixture apparatus of my invention comprises:

- a primary air passage having an inlet, an adjustable throttle and an outlet,
- a secondary air passage having an inlet and an outlet to the primary air passage between its adjustable throttle and its outlet and
- a nozzle for introducing fuel into the secondary air passage, whereby in use the fuel mixes with the air flowing through this passage prior to mixing with the air flowing in the primary air passage.

Whilst it can be envisaged that the nozzle should be a fixed orifice nozzle, it preferably has a variable orifice. In the preferred embodiments, the nozzle has a tapered needle in its mouth to provide variability by axial movement of the needle. In one embodiment, the needle has a small bead, preferably a small ball or invert cone, at its tip for inducing divergence of the fuel as it flows from the end of the needle and/or for discouraging fuel flow to the point of the needle and linear drop formation from the point.

Normally, the inlet of the primary air passage will be connected to an air cleaner and the outlet will be connected to an inlet manifold of an internal combustion engine.

The inlet of the secondary air passage can be from the primary air passage between its inlet and its throttle. Alternatively the inlets to the two air passages can be independent of each other, but normally downstream of the same air cleaner.

The outlet of the secondary air passage may be provided at a fixed throat in the primary air passage, to induce increased air flow speed in the primary passage and reduced pressure at the outlet of the secondary air passage for enhanced air flow in the secondary air passage. In one embodiment, a plurality of outlets from the secondary air passage are provided at the fixed throat. The secondary air passage has a branch surrounding the primary air passage, the said outlets being from tile branch and spaced around the primary air passage.

In one embodiment, the secondary air passage is provided with a constriction for inducing increased air flow speed therethrough and the nozzle is arranged at the constriction whereby the fuel is mixed with the air at its region of increased flow speed. The constriction can be formed as an annular space between the nozzle or the needle and a ring. Preferably the ring has up- and down-stream bevels meeting at an edge for inducing turbulence.

In another embodiment, the secondary air passage is provided with a chamber, with the nozzle being arranged to inject fuel into the chamber for initial fuel-air mixing in the chamber. The passage may have a constriction at the upstream and/or downstream ends of the chamber. When at the downstream end, the constriction can be at the outlet from the secondary air passage to the primary air passage.

The constriction(s) is/are preferably configured to induce turbulence in the air flow in the secondary air passage, to enhance the mixing of the fuel with the air, suitably by forming the constriction with a pair of bevels meeting at an edge.

Alternatively, or in addition to the constriction(s), the portion of the secondary air passage upstream of the chamber may approach the chamber at least substantially tangentially thereto, so as to induce swirling of the air flow in the chamber. In this embodiment, the nozzle is preferably arranged to introduce the fuel at the centre of the swirl, whence it can radiate for mixing with the air.

In one embodiment, the nozzle is so arranged that the fuel leaving its orifice impinges on an ultrasonic transducer for comminution of the fuel into small droplets.

In one embodiment, a linkage is provided for linking the needle to the adjustable throttle in the primary air passage for adjustment of the orifice of the nozzle, whereby the fuel flow from the nozzle is matched to the air flow in the two passages.

In another embodiment, a control device is provided for servo control of the nozzle orifice is in accordance with measurement(s) of throttle position and/or engine parameters including the composition of the exhaust from the engine, whereby the fuel flow from the nozzle is matched to the air flow in the two passages.

Whilst it can be envisaged that fuel flow from the nozzle may be induced by depressed pressure in the device at the nozzle's orifice; normally a pump will be provided for pumping fuel will be pumped to the nozzle. Preferably, the pump will be adapted to deliver fuel to the nozzle at substantially constant pressure.

It is envisaged that the fuel may be gaseous or liquid.

THE DRAWINGS

Figure 2:
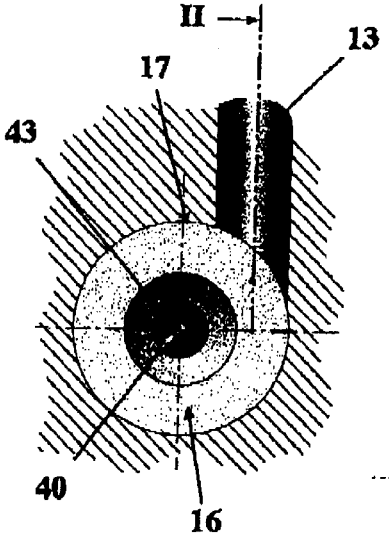
Figure 3:
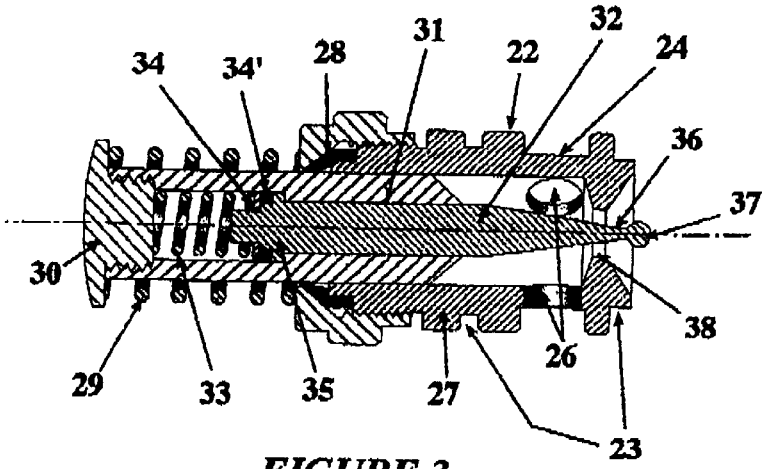
Figure 4:
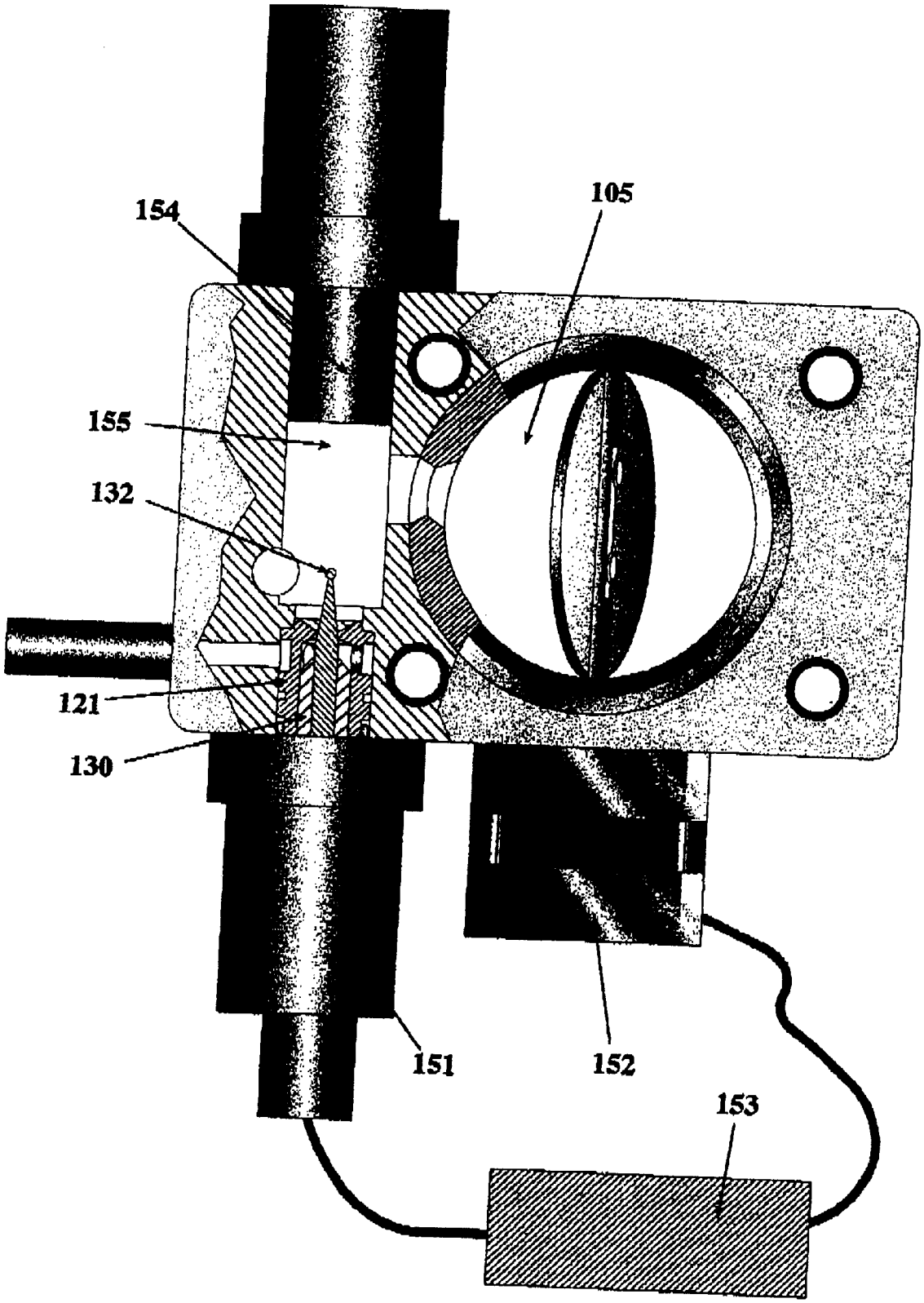
Figure 5:
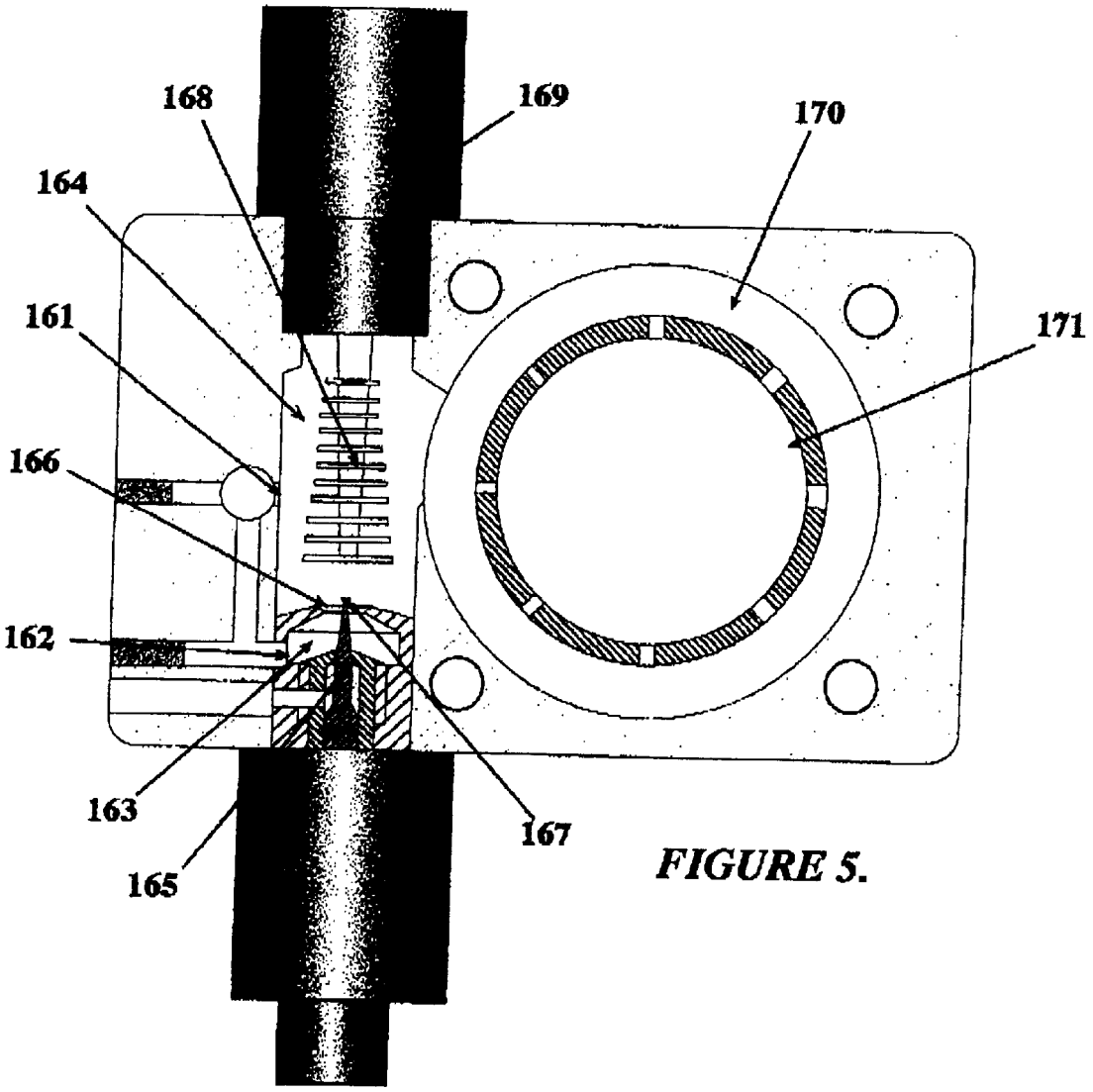
Figure 6:
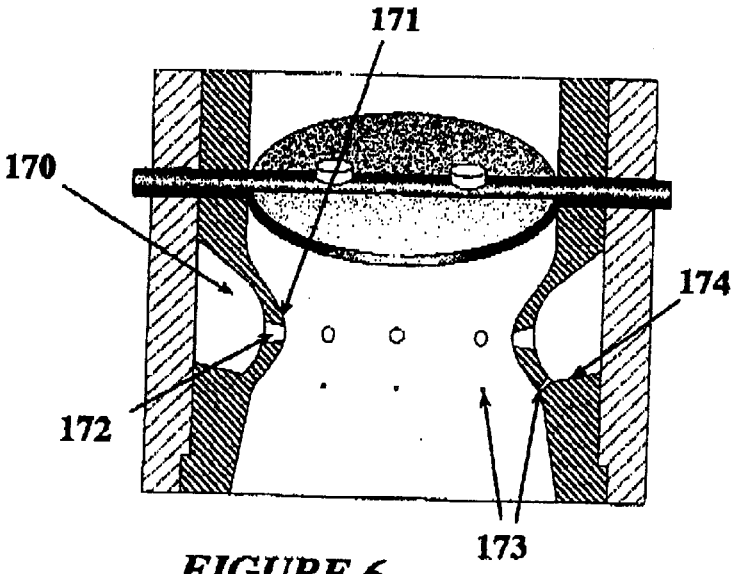
Figure 7:
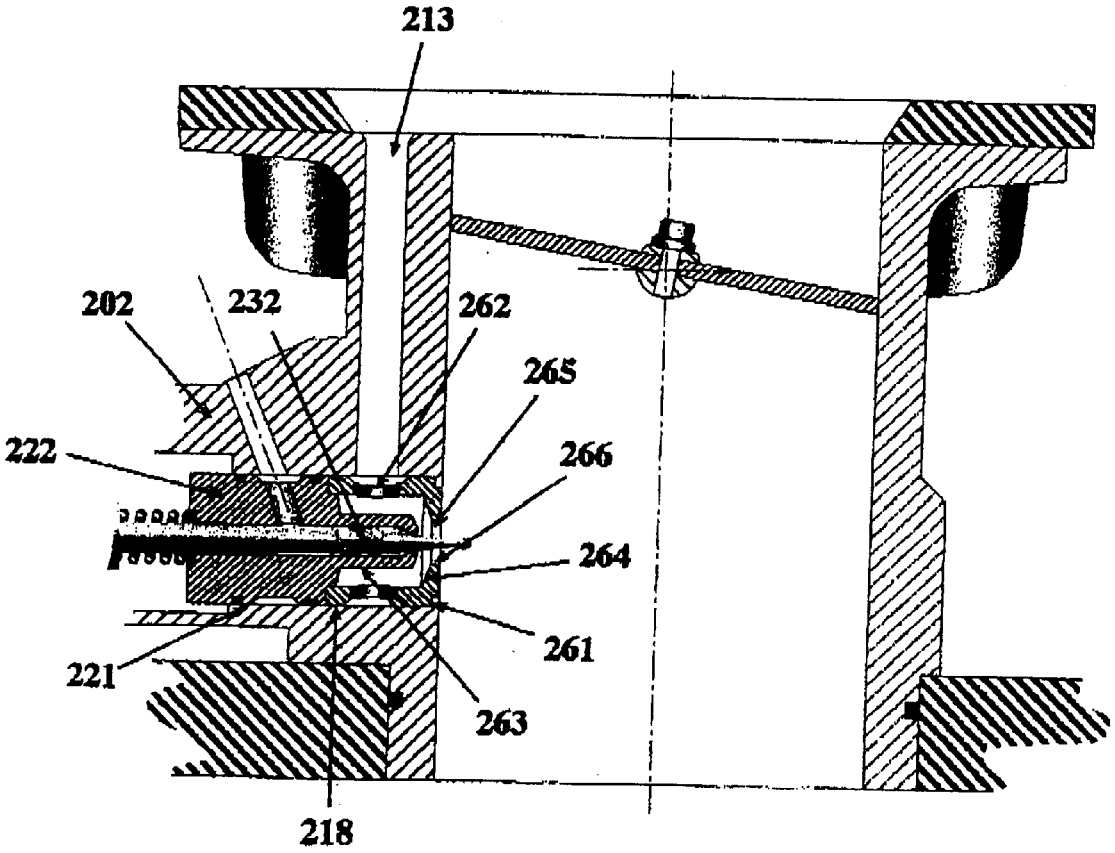

To help understanding of the invention, three specific embodiments thereof will now be described by way of example and with reference to the accompanying drawings, in which:

FIG. 1 is a lateral cross-sectional view of a body of a fuel-air mixture apparatus according to the invention, FIG. 2 is a scrap cross-sectional view on the line II—II in FIG. 1 of a mixture chamber in a secondary air passage, FIG. 3 is similar cross-sectional view as FIG. 1, but on a larger scale, of a nozzle device of the fuel-air mixture apparatus, FIG. 4 is a plan cross-sectional view of a second fuel-air mixture apparatus according to the invention, FIG. 5 is a view similar to FIG. 4 of a variant of the second fuel-air mixture apparatus, FIG. 6 is a cross-sectional side view showing throttles in the primary air passage and FIG. 7 is a view similar to FIG. 1 of a third fuel-air mixture apparatus according to the invention.

FIRST EMBODIMENT

The fuel-air mixture apparatus 1 has a body 2 adapted for connection via a flange 3 to an air cleaner housing 3' (only partially shown) and via a spigot 4 to an engine inlet manifold 4' (again only partially shown). In the body 2 is arranged a primary air passage 5 having an inlet 6, an adjustable throttle 7, a throat 8 and an outlet 9. The throttle will be connected in use to a speed control device for the engine (not shown), typically an accelerator pedal of a car or a governor, via a linkage 10. The throat is provided in a tubular insert 11, with the internal diameter of the throat chosen to match the size of the engine to which the device 1 is fitted. Where the throat is smaller than that shown in FIG. 1, the tubular insert may have an upper extension as far as the throttle 7, which is provided with a smaller butterfly 12 to suit.

Also provided in the body 2 is a secondary air passage 13 having an inlet 14 from the air cleaner housing and an outlet 15 to the primary air passage 5. This is at the throat 8 and will be described in more detail below. Towards its downstream end, the secondary air passage opens into a chamber 16, with the opening 17 being arranged tangentially to the chamber to induce swirling air flow in the chamber. The outlet 11 is provided axially of the chamber.

At the other end of the chamber, in a bore 18 in the body a nozzle device 21 is provided. It comprises a main sleeve 22 having two O-ring grooves 23 for O-rings 23' sealing a circumferential void 24 to the body. This void has a fuel supply bore 25 in the body 2 and connected to a continuous fuel pump (not shown) opening into it. A fuel inlet 26 leads from the void to an internal bore in the sleeve 22. Slidably mounted in the sleeve is a guide 27, sealed to the sleeve via a gland 28. The outside end of the guide carries a compression spring 29 and tile end of the guide is closed by a plug 30 providing an abutment for the spring, whereby the guide is urged outwards.

The guide has a bore 31 in which a needle 32 is slidably mounted. A spring 33 acts between the plug 30 and a washer 34 acting on an O-ring 34' abutting a head 35 of the needle. The latter has a point 36, carrying a small ball 37, which extends through a gauged aperture 38 in the end of the sleeve 22. This arrangement is such that when the plug 30 is pushed fully inwards of the body, as on closure of the throttle, the needle closes the aperture 38 and the fuel supply to the engine, but the force with which the needle is urged into the aperture is regulated by the internal spring 33.

In use, the plug 30 is acted on by an abutment member 40, which is movable in step with the throttle 7 via a branch of the linkage 10. The arrangement is such that as the throttle 7 is progressively opened, the abutment member is progressively withdrawn to withdraw the needle point 36 from the aperture 38. This allows more fuel to flow through the bore 25, inlet 26 and aperture 38. The linkage is designed to ensure that the stoichometricly required amount of fuel is provided for the throttle opening.

The major portion of the air drawn into the engine flows through the primary air passage 5. A small amount of air flows in the secondary air passage 13. As mentioned above, this air flow enters the chamber 16 and causes swirling air flow there. Fuel leaving the nozzle device 21 on the axis of the chamber spreads radially in this air flow, mixing with it. The fuel is induced to leave the needle point 36 at the ball 37 in small droplets, which enhances vaporisation of the fuel. It and tile air leaves the chamber at a constriction 40 in the insert 11, formed as a pair of up- and down-stream facing bevels 41,42 defining an edge 43, which induces further turbulence in the secondary air flow as it meets the primary air flow. This flow is also turbulent downstream of the throttle 7. The result is thorough mixing of the fuel and the air prior to induction into the engine. It should be noted that tile fuel flows continuously from the nozzle device and mixes continuously with first the secondary air flow and then the primary air flow.

Second Embodiment

Turning now to FIG. 4, a second embodiment is shown in which the nozzle device 121 is arranged tangentially to the primary air passage 105 arid is of simpler construction, whereby its plug 130 is driven by a threaded shaft output (not shown) from a stepper motor 151 or a linearly controllable, electromagnetic actuator under control from an engine management computer 153, whose programming will be within the domain of the man skilled in the art and will not therefore be described. The computer 153 also controls a second stepper motor 152 connected to the throttle for controlling its position. In addition to the computer control of the needle 132, this embodiment includes an ultrasonic transducer 154 against the face 155 of which the fuel from the needle is introduced. This has the effect of disintegrating the fuel droplets for their vaporisation in the swirling secondary air flow In other respects, this embodiment is similar to the embodiment of FIG. 1.

Variant of the Second Embodiment

FIGS. 5 & 6 show a variant of the second embodiment, in which the secondary air passage has two branches 161,162 leading to two chambers 163,164. The first chamber 163, to which the first branch 161 leads, is similar to that 16 in the first embodiment, in that it accommodates the needle 165. The latter extends through a constriction 166, similar to that 40 of the first embodiment, and has a small invert cone 167 at its end. The cone is arranged to provide a sharp edge from which fuel droplets shed into the air-stream through the constriction. The second chamber 164 is fed with air from the second branch 162. The two secondary air-streams meet in the region of a sonde 168 of an ultrasonic transducer 169. The fuel droplets from the needle impinge on the sonde and are comminuted. The secondary air flow with the fuel leaves the second chamber and enters an annular passage 170 behind a fixed throttle insert 171. The insert has two series of drillings 172, 173 equi-angularly spaced around it. Upper ones 172 of these are at smallest diameter section of the throttle and convey the bulk of the secondary air flow into the primary air flow through the throttle. The lower drillings 173 are drains from a groove 174 at the back of the insert, the groove being downwardly directed to drain any fuel liquid, which may accumulate therein, into the primary air passage 105. To arrange for the flow through the individual ones of the upper drillings 172 to be as even as possible, bearing in mind the longer flow path from the second chamber 164, the drillings further from this chamber are larger.

Third Embodiment

Turning on to FIG. 7, the third embodiment there shown differs from the first and second embodiments in not having a chamber in its secondary air passage 213. Rather its nozzle device 221 incorporates a nose 261 mounted with the device in the bore 218 in the body 202. Tile nose has a lateral inlet 262 for the secondary air flow which impinges on a tip 263 of the needle sleeve 222 and is accelerated as it flows through a tapered outlet 264 of the nose. This outlet has a further taper 265 back-to-back with tile taper 264, forming a constriction 266, causing the secondary air to be turbulent on leaving the nose. The constriction is arranged to be the outlet of the secondary air passage. The fuel introduction orifice, between the nozzle 221 and the needle 232 is close to the constriction, with the needle actually extending into the constriction. The arrangement induces fine fuel droplet formation and vaporisation of the fuel in the secondary air as it mixes with the primary air flow.

It should be noted that the engine management computer can enrich the fuel-air mixture for cold starting, but the degree of enrichment is less than that required with a conventional carburettor.

The invention is not intended to be restricted to the details of the above described invention. For instance, the engine management computer can incorporate additional features, allowing adaptation of the apparatus to the type of fuel, grade of fuel and style of driving of the vehicle in which the apparatus is installed. Further, the invention find application other than in internal combustion engines. It may for instance be used in boilers.

We claim:

1. A fuel-air mixture apparatus comprising:

(a) a primary air passage having an inlet, an adjustable throttle for controlling air flow in said primary air passage and an outlet;

(b) a secondary air passage having an inlet and an outlet to said primary air passage between its adjustable throttle and its outlet;

(c) a nozzle having an orifice opening into said secondary air passage for introducing a flow of fuel therein;

(d) a needle arranged coaxially of said nozzle with its small diameter end at least normally extending from said orifice into said secondary air passage, said needle being axially movable to provide variability of said orifice of said nozzle and control of said fuel flow through said nozzle; and (e) a linkage or control device for directly linking or controlling the position of said needle to the position of said adjustable throttle in said primary air passage for adjustment of said orifice of said nozzle;

the arrangement being such that in use the fuel flow from said nozzle is matched to the position of said adjustable throttle and the fuel flowing from said orifice towards said small diameter end of said needle mixes with the air flowing through said secondary passage prior to mixing with the air flowing in said primary air passage.

2. A fuel-air mixture apparatus according to claim 1, wherein said control device is adapted to provide for control of the position of said needle in accordance with engine parameters including the composition of the exhaust from the engine in addition to the position of said throttle.

3. A fuel-air mixture apparatus according to claim 1, wherein said needle has a small bead at its point for discouraging fuel flow to said point of said needle and linear drop formation from said point and/or for inducing divergence of the fuel as it flows from the end of said needle.

4. A fuel-air mixture apparatus according to claim 3, wherein said small bead is a small ball or invert cone.

5. A fuel-air mixture apparatus according to claim 1, wherein said inlet of said primary air passage is adapted to be connected to an air cleaner and said outlet of said primary air passage is adapted to be connected to an inlet manifold of an internal combustion engine.

6. A fuel-air mixture apparatus according to claim 1, wherein said inlet of said secondary air passage is from said primary air passage between its inlet and its throttle.

7. A fuel-air mixture apparatus according to claim 1, wherein said primary air passage and said secondary air passage are independent of each other.

8. A fuel-air mixture apparatus according to claim 7, wherein said inlet of said primary air passage is adapted to be connected to an air cleaner and where inlets to said two air passages are arranged to be downstream of same said air cleaner.

9. A fuel-air mixture apparatus according to claim 1, wherein said outlet of said secondary air passage is provided at a fixed throttle in said primary air passage, said fixed throttle inducing increased air flow speed in said primary passage and reduced pressure at said outlet of said secondary air passage for enhanced air flow in said secondary air passage.

10. A fuel-air mixture apparatus according to claim 9, wherein there are provided a plurality of outlets from said secondary air passage at said fixed throat.

11. A fuel-air mixture apparatus according to claim 10, wherein said secondary air passage has a branch surrounding said primary air passage, said outlets being from said branch and spaced around said primary air passage.

12. A fuel-air mixture apparatus according to claim 1, wherein said secondary air passage is provided with a constriction for inducing increased air flow speed therethrough and said nozzle is arranged at said constriction whereby the fuel is mixed with the air at its region of increased flow speed.

13. A fuel-air mixture apparatus according to claim 12, wherein said constriction is formed as an annular space between a ring and said nozzle or said needle.

14. A fuel-air mixture apparatus according to claim 13, wherein said ring has up- and down-stream bevels meeting at an edge for inducing turbulence.

15. A fuel-air mixture apparatus according to claim 1, wherein said secondary air passage is provided with a chamber with said nozzle being arranged to inject fuel into said chamber for initial fuel-air mixing in said chamber.

16. A fuel-air mixture apparatus according to claim 15, wherein said passage has a constriction at the upstream and/or downstream end(s) of said chamber.

17. A fuel-air mixture apparatus according to claim 16, wherein said constriction is at said outlet from said secondary air passage to said primary air passage.

18. A fuel-air mixture apparatus according to claim 16, wherein said constriction(s) is/are configured to induce turbulence in the air flow in said secondary air passage, to enhance the mixing of the fuel with the air.

19. A fuel-air mixture apparatus according to claim 18, said constriction is formed with a pair of bevels meeting at an edge.

20. A fuel-air mixture apparatus according to claim 15, wherein a portion of said secondary air passage upstream of said chamber approaches said chamber at least substantially tangentially thereto, so as to induce swirling of the air flow in said chamber.

21. A fuel-air mixture apparatus according to claim 20, wherein said nozzle is arranged to introduce the fuel at the center of the swirl, whence it can radiate for mixing with the air.

22. A fuel-air mixture apparatus according to claim 21, wherein said nozzle is so arranged that the fuel leaving its orifice impinges on an ultrasonic transducer for comminution of the fuel into small droplets.

23. A fuel-air mixture apparatus according to claim 1, wherein said apparatus is adapted and arranged for fuel flow from said nozzle to be induced by depressed pressure at said nozzle.

24. A fuel-air mixture apparatus according to claim 1, including:

(a) a member providing said nozzle opening into said secondary air passage and having a bore;

(b) a sleeve movably mounted in said bore, having its own bore, in which said needle is movably mounted;

(c) an abutment between said needle and said sleeve for limiting the extent of said needle from said sleeve towards said secondary air passage;

(d) a spring urging said needle outwards of said nozzle against said abutment, the arrangement being such that on closure of said throttle said needle closes said nozzle, with a force restricted to that applied to it by said spring, and on opening of said throttle said needle and said sleeve are in abutment; whereby said needle and said sleeve move together for withdrawal of said needle from said nozzle to the extent required to match the position of said throttle.

25. A fuel-air mixture apparatus according to claim 1, in combination with a pump provided for pumping fuel to said nozzle.

26. A fuel-air mixture apparatus according to claim 25, wherein said pump is adapted to deliver fuel to said nozzle at substantially constant pressure.

* * * * *